US012116187B2

(12) United States Patent
McGrath

(10) Patent No.: US 12,116,187 B2
(45) Date of Patent: Oct. 15, 2024

(54) METAL SAFETY CLOSURE WITH ENGAGING NOTCH

(71) Applicant: Van Blarcom Closures, Inc., Brooklyn, NY (US)

(72) Inventor: George McGrath, Brooklyn, NY (US)

(73) Assignee: VAN BLARCOM CLOSURES, INC., Brooklyn, NY (US)

( * ) Notice: Subject to any disclaimer, the term of this patent is extended or adjusted under 35 U.S.C. 154(b) by 0 days.

(21) Appl. No.: 18/605,000

(22) Filed: Mar. 14, 2024

(65) Prior Publication Data

US 2024/0308737 A1 Sep. 19, 2024

Related U.S. Application Data

(60) Provisional application No. 63/538,949, filed on Sep. 18, 2023, provisional application No. 63/452,223, filed on Mar. 15, 2023.

(51) Int. Cl.
*B65D 50/04* (2006.01)
*B65D 41/04* (2006.01)

(52) U.S. Cl.
CPC ..... *B65D 50/041* (2013.01); *B65D 41/04* (2013.01); *B65D 2215/02* (2013.01)

(58) Field of Classification Search
CPC ... B65D 50/041; B65D 41/04; B65D 2215/02
See application file for complete search history.

(56) References Cited

U.S. PATENT DOCUMENTS

| | | | | | |
|---|---|---|---|---|---|
| 2,980,274 | A | * | 4/1961 | Gould | B65D 50/041 215/220 |
| 3,809,272 | A | | 5/1974 | Maki | |
| 3,830,394 | A | | 8/1974 | Lestaevel | |
| 3,853,236 | A | | 12/1974 | Ostrowsky | |
| 3,915,326 | A | | 10/1975 | Hrubesky | |
| 3,924,770 | A | * | 12/1975 | Scuderi | B65D 50/041 215/220 |
| 3,968,894 | A | | 7/1976 | Herrmann | |
| 4,011,960 | A | | 3/1977 | Mauvernay | |
| 4,519,514 | A | | 5/1985 | Agbay | |
| 5,579,934 | A | * | 12/1996 | Buono | B65D 50/041 215/220 |

(Continued)

FOREIGN PATENT DOCUMENTS

| | | | |
|---|---|---|---|
| KR | 20120030495 | A | 3/2012 |
| WO | WO-2004063025 | A2 | 7/2004 |
| WO | WO-2006098559 | A1 | 9/2006 |

*Primary Examiner* — James N Smalley
(74) *Attorney, Agent, or Firm* — Cozen O'Connor

(57) ABSTRACT

A child resistant closure for use with a container having a threaded portion and an axis extending therethrough about which said closure is rotatable may be manufactured from a recyclable material such as tin plate metal or aluminum. The closure includes coaxial and nested inner and outer caps that are axially movable with respect to each other. An axial force causes notches in the outer cap to engage with knurls in the inner cap to transmit torque from the outer cap to the inner cap. Abutment surfaces on the notches interact with the knurls to cause the outer cap and the inner cap to move away from each other in the axial direction when axial force is removed. The knurls may to angled or straight with respect to the axis.

7 Claims, 6 Drawing Sheets

(56) References Cited

U.S. PATENT DOCUMENTS

| | | | |
|---|---|---|---|
| 6,722,513 | B1 | 4/2004 | Flood |
| 7,408,843 | B2 | 8/2008 | Brandon |
| 7,703,617 | B1 | 4/2010 | Branson |
| 7,819,264 | B2 | 10/2010 | Brozell |
| 7,988,003 | B1 | 8/2011 | Clodfelter |
| 9,784,979 | B2 | 10/2017 | Grenko |
| 2002/0027119 | A1 | 3/2002 | Miceli |
| 2004/0262251 | A1 | 12/2004 | Tauber |
| 2005/0150857 | A1 | 7/2005 | Brozell et al. |
| 2005/0230341 | A1 | 10/2005 | Dong |
| 2009/0014404 | A1 | 1/2009 | Russell |
| 2009/0120896 | A1 | 5/2009 | Scarlata |
| 2010/0313527 | A1 | 12/2010 | Jajoo |
| 2011/0139742 | A1 | 6/2011 | Brozell |
| 2015/0076103 | A1 | 3/2015 | Koller |
| 2016/0031615 | A1 | 2/2016 | Miceli |
| 2018/0229903 | A1 | 8/2018 | Lee |
| 2019/0144175 | A1 | 5/2019 | Patton |

* cited by examiner

METAL SAFETY CLOSURE WITH ENGAGING NOTCH

CROSS REFERENCE TO RELATED APPLICATIONS

The application claims priority to provisional applications U.S. Ser. No. 63/452,223 filed Mar. 15, 2023, titled "Metal Safety Closure with Angled Teeth" and U.S. Ser. No. 63/538,949 filed Sep. 18, 2023, titled "Metal Safety Closure with Engaging Notch," both incorporated herein by reference.

FIELD OF THE INVENTION

The present invention relates to a container closure that is selectively manipulable between a configuration which resists opening by children and a configuration which may be easily opened without special manipulation of the closure.

BACKGROUND

Child resistant closures are well-known and understood to be effective in preventing inadvertent access to potentially dangerous materials such as medications by children. However, inclusion of the child resistant feature on containers is costly, and all too often, makes it difficult and frustrating for an adult user to open the container, especially an adult who has suffered a loss of manual dexterity, as by arthritis. Because of deteriorating health, elderly persons tend to rely on medication more than the average person. The elderly may also tend to have impaired manual strength and dexterity. Due to the difficulty encountered by such persons in opening child-resistant packages, many elderly persons request a non-child resistant container instead. Alternatively, when medications are purchased in child resistant packages by older adults, the packages are oftentimes not reclosed by the user thus defeating the purpose of the child resistant feature.

An attempt to overcome the aforementioned problem is disclosed by Caetano Buono in U.S. Pat. No. 5,579,934, granted Dec. 3, 1996, which teaches a convertible child resistant closure for use with a container having a neck portion which allows a user to select between providing the container with a child resistant closure and an easily openable closure, depending upon the use and contents of the container. Coaxial inner and outer caps are axially moveable with respect to each other. The outer cap includes a plurality of lips so that the inner cap may be positioned in one of two regions: a first region provides a child resistant mode requiring an axial force to remove the closure while the second position may be operated without requiring an axial force in addition to a rotational force. However, the disclosed arrangement has a complicated structure that is difficult and expensive to fabricate.

Environmental concerns have led to a search for materials to replace plastic for a variety of uses. One material that is receiving attention for packaging applications is metal. This is because many metals and alloys are of which are easy to manufacture and infinitely recyclable. However, metal-based materials cannot typically be molded into complicated structures as easily as plastic, requiring new designs to meet the functionality provided by plastic.

It is thus desirable to provide a child-resistant closure that may be fabricated in an environmentally friendly material.

SUMMARY OF THE EMBODIMENTS

A child resistant closure for use with a container having a threaded portion and an axis extending therethrough about which said closure is rotatable is made from a recyclable material such as metal. The closure includes coaxial and nested inner and outer caps that are axially movable with respect to each other. An axial force causes notches in the outer cap to engage with knurls in the inner cap. When engaged, torque applied to the outer cap is transferred to the inner cap. Abutment surfaces on the notches interact with the knurls to cause the outer cap and the inner cap to move away from each other in the axial direction when axial force upgrade to the outer cap is removed, such as when a user releases the closure.

In a first embodiment, the knurls on the inner cap are angled with respect to an axis of the closure. In a second embodiment, the teeth on the inner cap are aligned with, i.e., parallel to, the axis. In either embodiment, spacing between adjacent knurls is configured to receive the notches from the outer cap when axial force is applied by a user to force engagement between the outer and inner caps, and to allow for unassisted disengagement therebetween when axial force is removed.

Thus, as disclosed herein, a child resistant closure with a structure that is easily fabricated in a metal is provided. Various features are pointed out with particularity in the claims annexed to and forming a part of the disclosure. For a better understanding of the child resistant closure, its operating advantages, and specific objects attained by its use, reference should be made to the drawings and descriptive matter illustrated and described herein.

DETAILED DESCRIPTION OF THE EMBODIMENTS

Reference will now be made in detail to embodiments, examples of which are illustrated in the accompanying drawings. The following description refers to the accompanying drawings in which the same numbers in different drawings represent the same or similar elements unless otherwise represented. The implementations set forth in the following description of embodiments do not represent all implementations consistent with the disclosure. Instead, they are merely examples of apparatuses and methods consistent with aspects related to the disclosure as recited in the appended claims.

Embodiments are disclosed in the context of a child resistant closure for medication, however, principles discussed herein may apply to any container having a threaded neck.

Figure 1A:
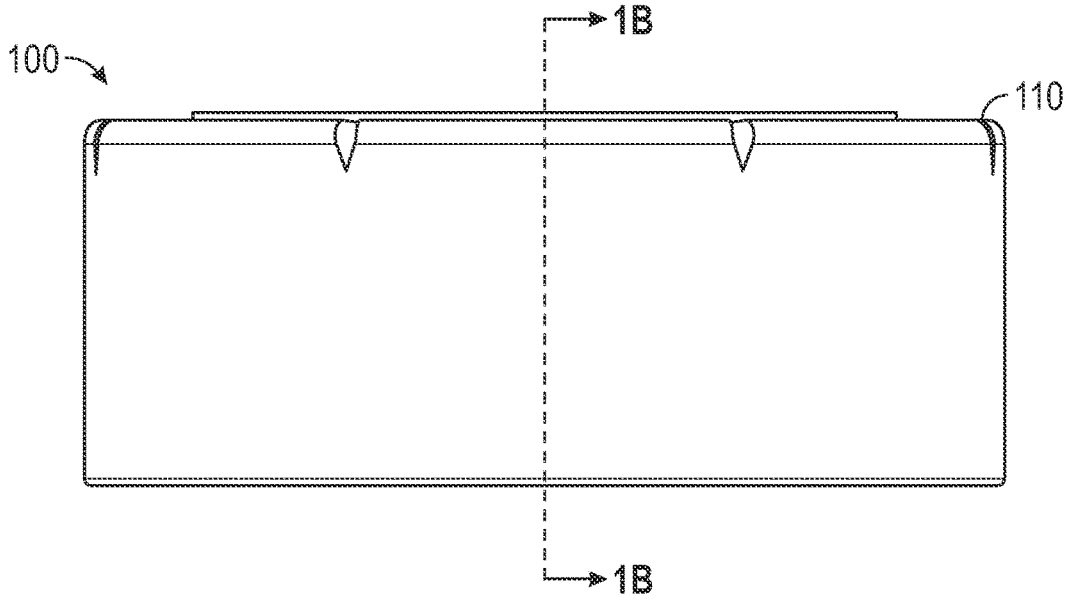
FIG. 1A is a side view of a child resistant closure, in embodiments.
Figure 1B:
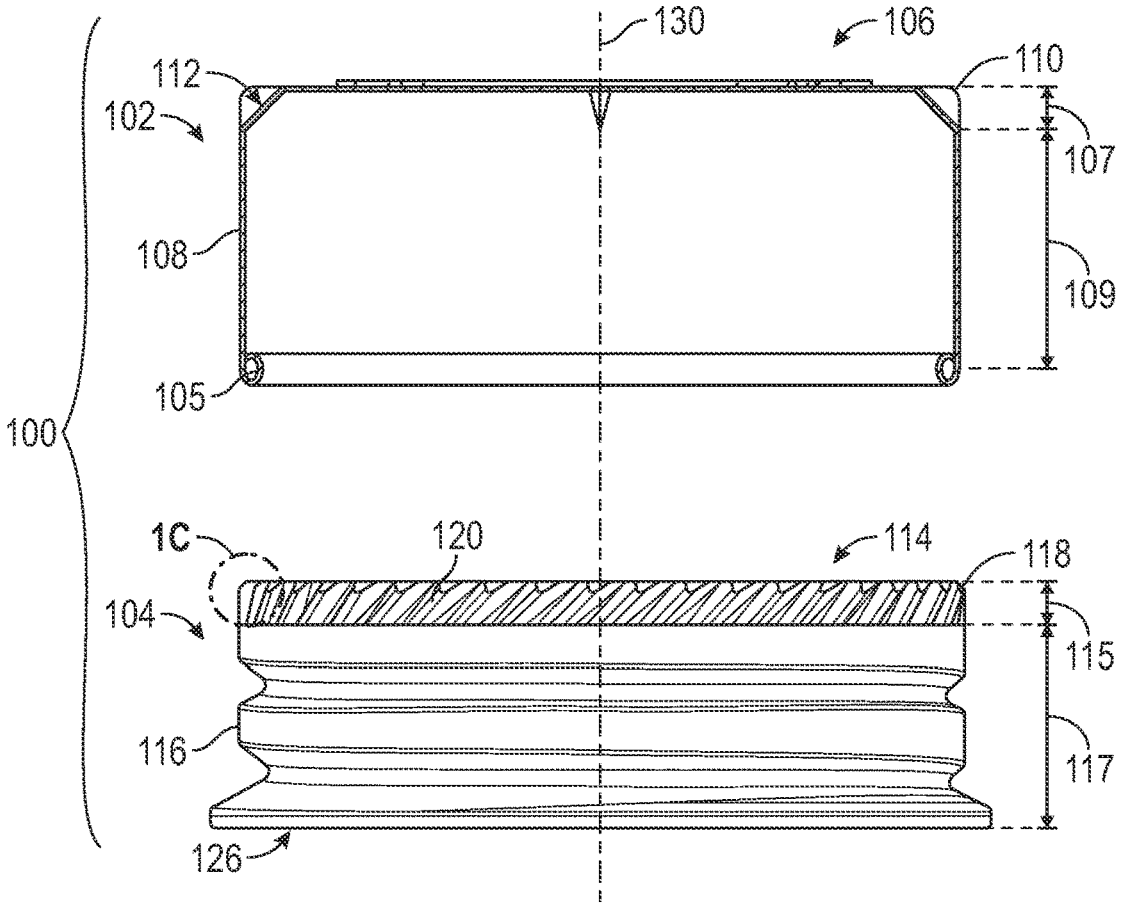
FIG. 1B is an exploded cross-sectional view of the child resistant closure of FIG. 1A showing the outer and inner caps, with the in their cap having angled knurls in accordance with a first embodiment.
Figure 1C:
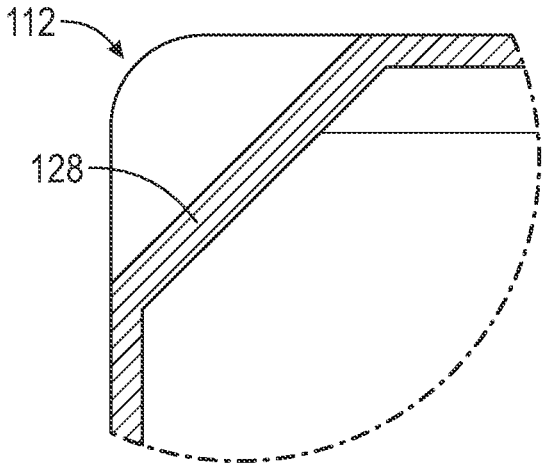
FIG. 1C is a detailed view of the outer cap of the child resistant closure of FIG. 1B.

FIGS. 1A-1C show various views of a child resistant closure 100. FIGS. 1A-1C are best viewed together in the following description.

FIG. 1A is a side view of closure 100 that is constructed for use with a container having a threaded neck portion (not shown). It is primarily directed for use with containers which store and dispense pharmaceutical products and the like but may also be used with any container having a threaded neck portion, irrespective of its contents. In embodiments, closure 100 is made of metal or metal alloy, such as tin plate metal, and may be used with a container made of plastic, metal or any material capable of retaining selected contents and being formed with a threaded neck for providing access to the contents.

FIG. 1B is an exploded cross-sectional view of closure 100 of FIG. 1A. Closure 100 generally circular and includes outer cap 102 and inner cap 104 that are axially aligned along axis 130 so that inner cap 104 nests inside outer cap 102. Selected exterior portions of the inner cap 104 engage corresponding interior portions of the outer cap 102. Outer cap 102 and inner cap 104 are maintained in the nesting arrangement in such a way that they can move towards and away from each other in the axial direction to allow or prevent, respectively, rotation of inner cap 104.

Outer cap 102 is generally cylindrical with an outer top wall 106 and an outer side wall 108. Outer top wall 106 and outer side wall 108 are approximately perpendicular where they meet at outer shoulder 110. Inner cap 104 is generally cylindrical with an inner top wall 114 and an inner side wall 116 that depends therefrom. Inner top wall 114 and inner side wall 116 are approximately perpendicular where they meet at inner shoulder 118. Inner side wall 116 and outer side wall 108 may also be referred to as inner and outer skirts. As an example, for a 38 mm diameter cap, the preferred diameter of closure 100 is about 4.37 cm (1.72 inches). Caps of different sizes will, likewise, be paired with different sized closures. Outer cap 102 includes a retaining lip 105 inside a lower edge of outer side wall 108 to maintain inner cap 104 in a nesting relationship when closure 100 is removed from a container.

Inner side wall 116 below shoulder 118 includes upper and lower sections. Knurl section 115 is just below shoulder 118 and includes a plurality of teeth or knurls 120. As shown in FIG. 1B, knurls 120 are consistently angled with respect to a vertical plane including axis 130 to form a spiral. Knurls 120 extend around the entire circumference of inner top wall 114. The angle of the knurls may be in the range of 30 degrees to 60 degrees. Preferably, the angle is approximately 45 degrees.

Inner side wall 116 also includes a threaded section 117 so that interior surface 126 of inner side wall 116 engages with a threaded exterior surface of a container neck when closure 100 is rotated in a closing direction, for example, clockwise. Conversely, the inner cap 104 may be removed from the threaded portion of a container neck by rotation of the closure 100 in an opening direction, e.g., counterclockwise.

Outer cap 102 includes a series of notches 112 in outer shoulder 110 around the circumference of outer top wall 106. Outer side wall 108 includes upper and lower sections. Notches 112 are formed in upper section 107. These notches are generally V-shaped when viewed from above and sized to selectively engage with knurls 120 of inner cap 104. Although a number of notches 112 and knurls 120 are shown herein, this is for purposes of illustration, and other numbers of notches and knurls may be employed. The remainder of outer side wall 108 may be referred to as lower section 109.

As shown in more detail in FIG. 1C, notches 112 include an abutment surface 128 that contacts knurls 120 when outer cap 102 and inner cap 104 are pressed together along axis 130. Abutment surface 128 may be formed when notches 112 are punched or pressed in outer shoulder 110. For example, abutment surface 128 is a portion of shoulder 110 that has been pressed towards the interior of outer cap 102.

As will be described in more detail below in connection with FIGS. 3A-3D, the combined heights along axis 130 of knurl section 115 and threaded section 117 of inner cap 104 is less than or equal to the height of lower section 109 of outer cap 102 along axis 130.

Figure 2A:
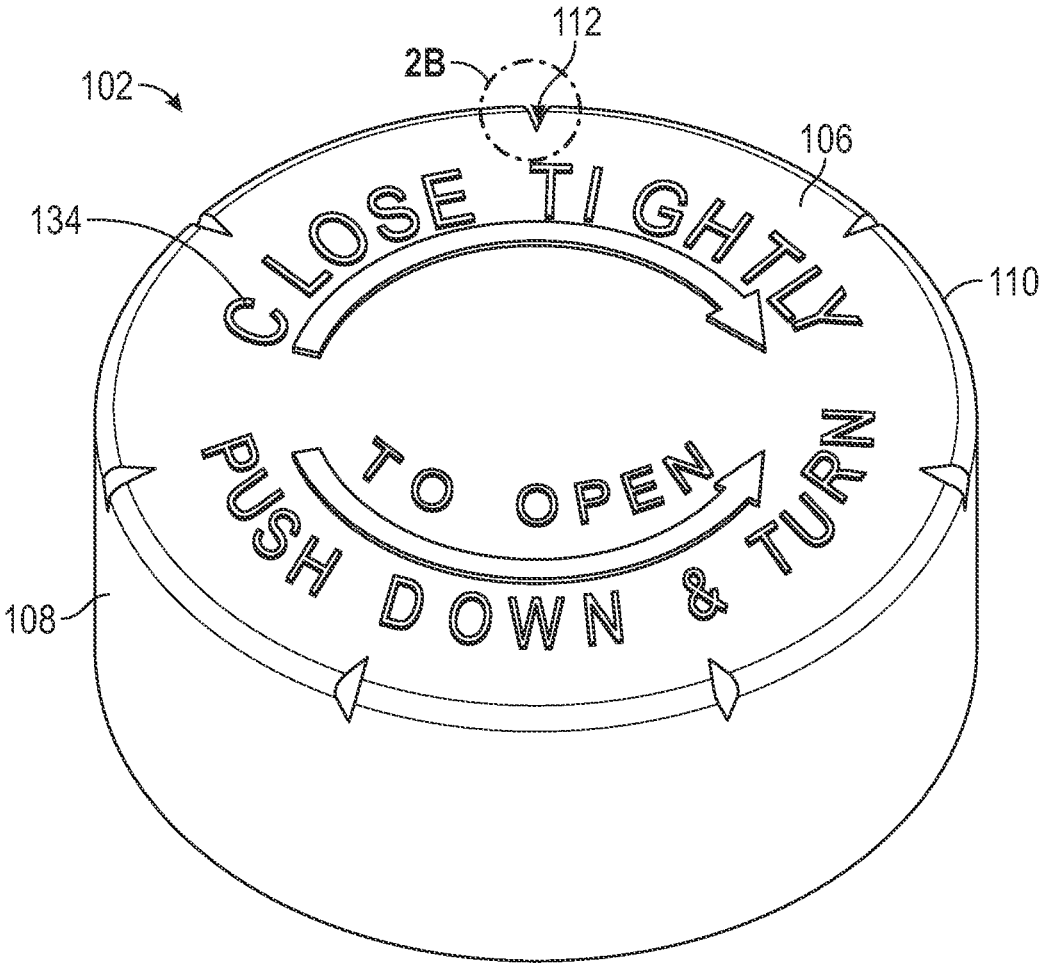
FIG. 2A is a perspective view of the outer cap of the child resistant closure of FIG. 1B.
Figure 2B:
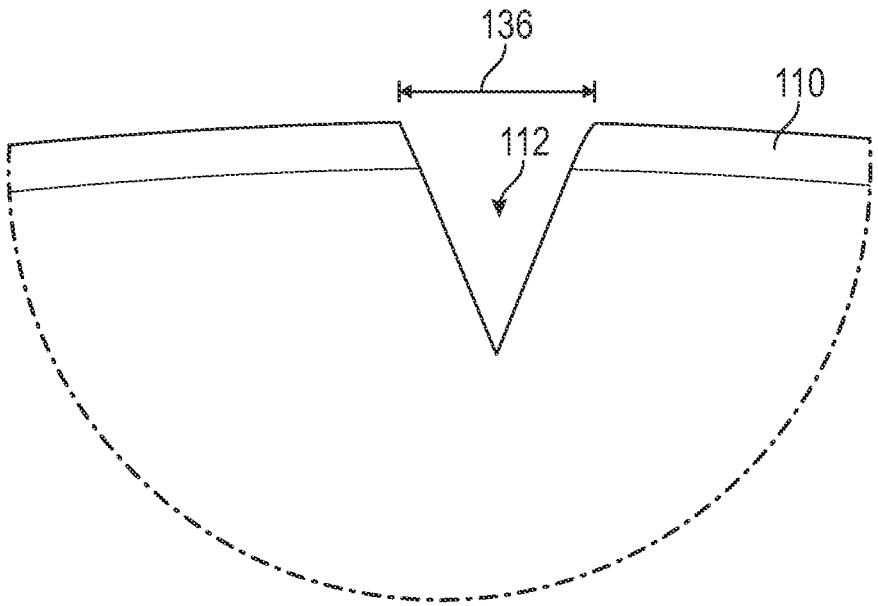
FIG. 2B is a detail view of a notch of the child resistant closure of FIG. 2A.

FIG. 2A is a perspective view of outer cap 102 of closure 100. FIG. 2B is a detail view of notch 112 in outer cap 102. Outer top wall 106 meets outer side wall 108 at shoulder 110. A plurality of notches 112 are formed around the circumference of outer top wall 106 in shoulder 110. Seven notches 112 are shown in FIG. 2A, but any number of notches may be provided.

As shown in FIG. 2B, notches 112 form a gap, or break 136, in shoulder 110 where the material of shoulder 110. In embodiments, notches 112 may be punched, or pressed, towards the interior of outer cap 102 to form abutment surface 128 (FIG. 3B). Other methods for forming notches are contemplated. In further embodiments, notches 112 may be formed in shoulder 110 as outer cap 102 is formed, such as by molding or additive manufacturing. In embodiments, indicia 134 such as instructions for opening closure 100 may be formed in, embossed on, or printed on outer top wall 106 as shown. Outer cap 102 may also incorporate serrations or knurling (not shown) on the outer surface of the outer side wall 108 for case in gripping and rotating outer cap 102 by a user. In embodiments, serrations would preferably extend vertically along the length of outer side wall 108 and may be positioned about the entire circumference of the outer side wall 108, or alternatively, selected portions thereof.

Figure 3A:
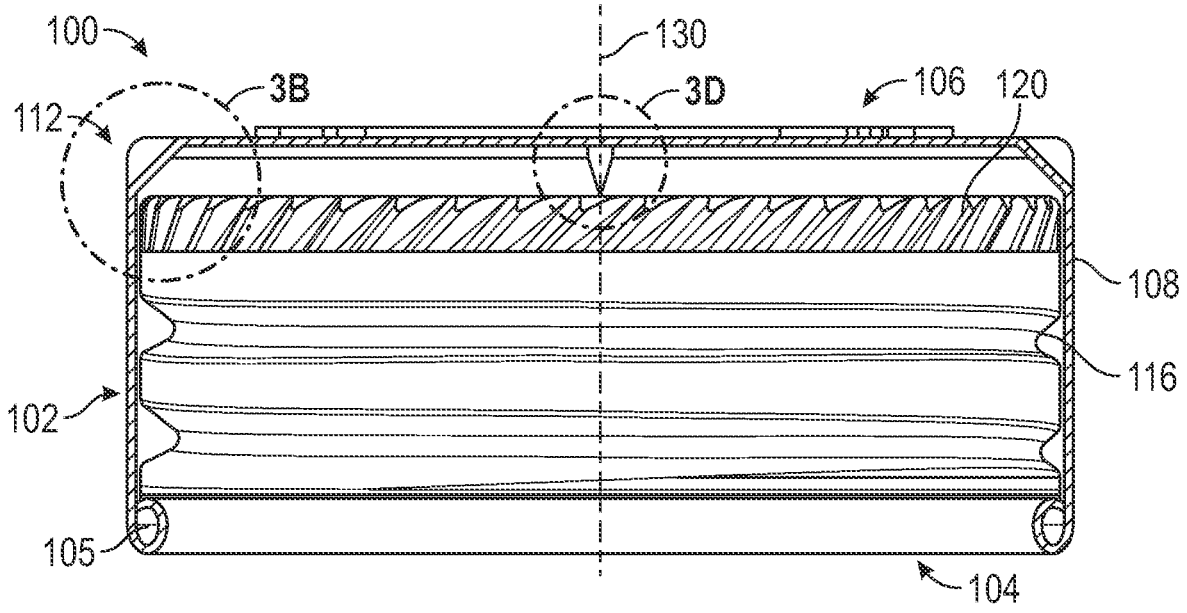
FIG. 3A is a side cutaway view of the child resistant closure of FIG. 1A showing the inner cap nested in the outer cap.
Figure 3B:
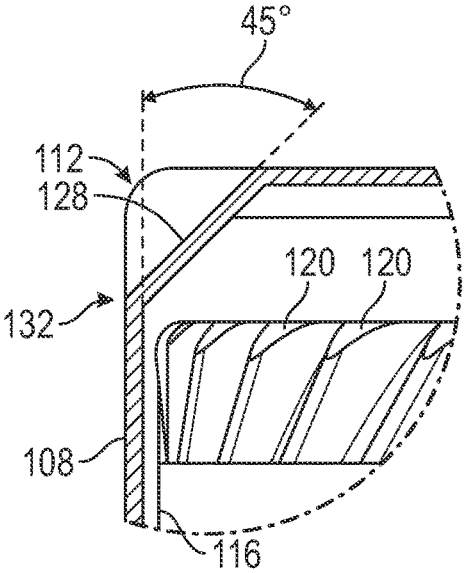
FIGS. 3B and 3C are detailed view of the notches in the outer cap of FIG. 3A.
Figure 3C:
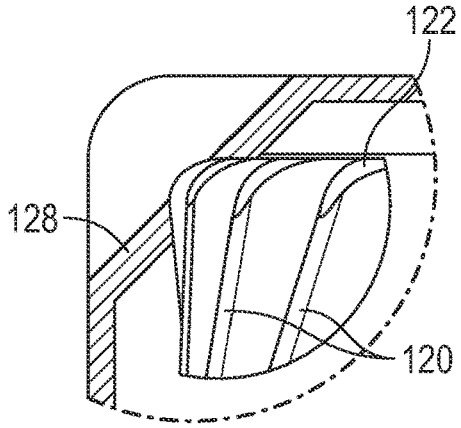
Figure 3D:
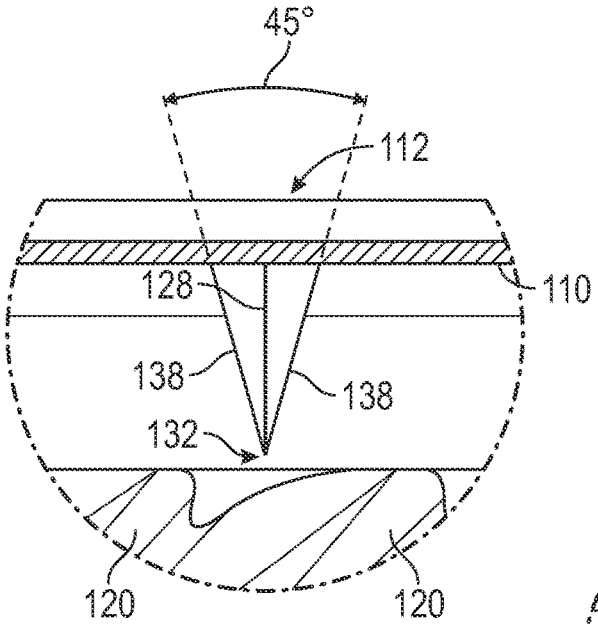
FIG. 3D is a detail side view of the child resistant closure of FIG. 3A.
Figure 3E:
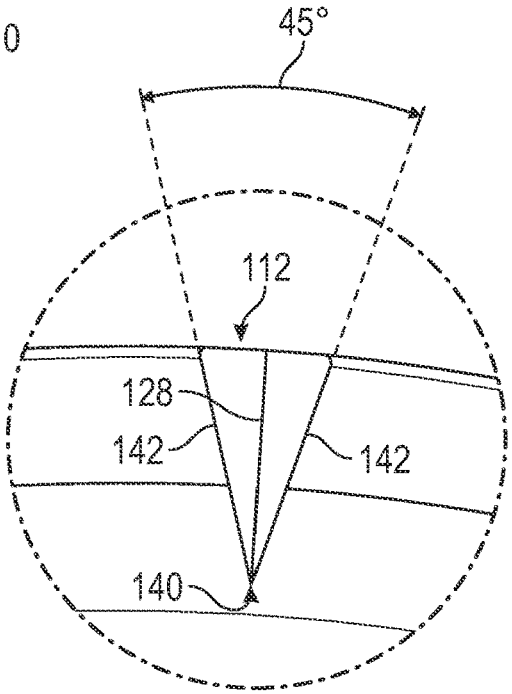
FIG. 3E is a detail top view the child resistant closure of FIG. 3A.

FIG. 3A is a cutaway view of closure 100 showing inner cap 104 nested in outer cap 102. FIGS. 3B and 3C are a detail side views of the interaction between notch 112 and knurl 120. FIG. 3D is a detail side view of the child resistant closure of FIG. 3A. FIG. 3E is a detail top view the child resistant closure of FIG. 3A. FIGS. 3A-3E are best viewed together in the following description.

In FIG. 3A, inner cap 104 is nested within outer cap 102 so that outer side wall 108 of outer cap 102 is coaxial with and peripherally surrounding inner side wall 116 of inner cap 104. Retaining lip 105 inside a lower edge of outer side wall 108 retains inner cap 104 in a nesting relationship. FIG. 3B shows a detailed side view of a representative notch 112 and knurls 120 when outer cap 102 is disengaged from inner cap 104. The angle defined between each abutment surface 128 and the vertical plane of outer side wall 108 is in the range of about 40° to about 50°, and preferably close to 45°. FIG. 3C shows a detailed side view of notch 112 and knurls 120 when outer cap 102 is engaged with inner cap 104.

As shown in FIG. 3D, notch 112 includes edges 138 that extend downward from shoulder 110 into outer side wall 108 to a point 132. Edges 138 of notch 112 extend upwards from point 132 to form an angle with each other in the range of about 30° to about 60°, and preferably close to 45°. In embodiments, abutment surface 128 is centered between edges 138 of notch 112. As shown in FIG. 3E, notch 112 includes edges 142 that extend inward from shoulder 110 into outer top wall 106 to a point 140. Edges 142 of notch 112 extend inwards from point 140 to form an angle with each other in the range of about 30° to about 60°, and preferably close to 45°. In embodiments, abutment surface 128 is centered in notch 112 and extends from point 132 in outer side wall 108 to point 140 in outer top wall 106.

Although a single notch 112 is shown in FIGS. 3B-3E, all notches in outer cap 102 would function similarly. Further, all notches 112 around the circumference of outer top wall 106 would engage with a respective knurl 120 at the same time. When outer cap 102 is pressed towards inner cap 104 along axis 130, abutment surface 128 of each notch 112 is received between respective knurls 120. As will be described in more detail below, when outer cap 102 is forced downward and rotated, abutment surface 128 presses against adjoining knurls 120 to cause inner cap 104 to rotate, as well. When abutment surface 128 is not inserted between adjoining knurls, outer cap 102 rotates freely, thus providing a closure resistant to opening by a child. Knurls 120 are preferably curved at corner 122 to facilitate the insertion of notch 112 between any two adjacent knurls 120 regardless of their initial alignment.

In embodiments, abutment surface 128 of notch 112 forms an angle of 45° with both outer side wall 108 and outer top wall 106. In addition, edges 138 form an angle of 45° with each other as measured from point 132 and edges 142 form an angle of 45° with each other as measured from point 140. This shape and size of notch 112 facilitates engagement and disengagement with knurl 120. In embodiments, notch 112 is able to compress slightly as it is inserted between knurls 120 when downward force is applied to outer cap 102. When the downward force is removed, the compression of notch 112 results in an upward force on outer cap 102 to separate it from inner cap 104 and provide the child safety function of closure 100.

Figure 4A:
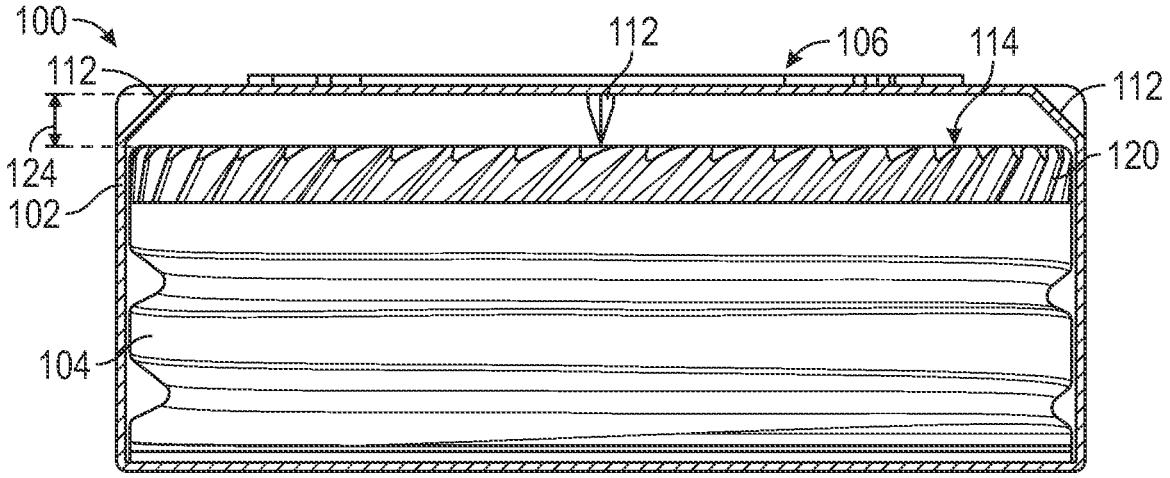
FIGS. 4A-4C show the relative positioning of the inner and outer caps of FIG. 3A when the child resistant closure is being removed from a container, in embodiments.
Figure 4B:
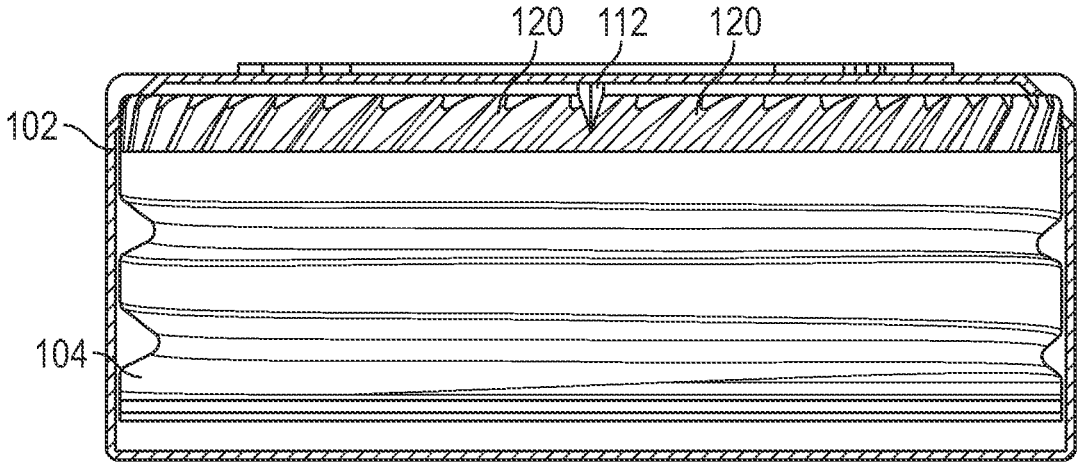

Operation of the child resistant closure 100 will now be described with a reference to FIGS. 4A-4C. FIG. 4A shows the relative position of inner cap 104 and outer cap 102 when closure 100 is fastened to a container using threads on the interior surface 126 (FIG. 1B) of inner cap 104 and corresponding threads on the container. A child resistant mode is provided by gap 124 between the outer surface of inner top wall 114 and the inner surface of outer top wall 106. Gap 124 ensures that, when the closure is in a "rest" state, namely, not being engaged by a user, notches 112 do not engage knurls 120. Thus, outer cap 102 may rotate freely while inner cap 104 remains securely threaded onto the container.

To gain access to the contents of a container with closure 100, the user must utilize both a rotative and an axial force. It is the axial force that causes abutment surface 128 of notches 112 of outer cap 102 to engage in spaces between knurls 120, as shown in FIG. 4B. When so-engaged, the outer cap 102 is rotated in an opening direction, here counterclockwise, with the use of both rotational and axial force, such that abutment surface 128 of each notch 112 transmits torque against knurls 120. This causes the inner and outer caps to turn together, e.g. to cause the inner cap 104 to remain rotationally stationary relative to the outer cap 102 and to thereby rotate the inner cap 104 causing it to disengage from threads on the neck of the container. Closure 100 may also be secured to a container using both an axial force and a rotative force in the clockwise direction.

Figure 4C:
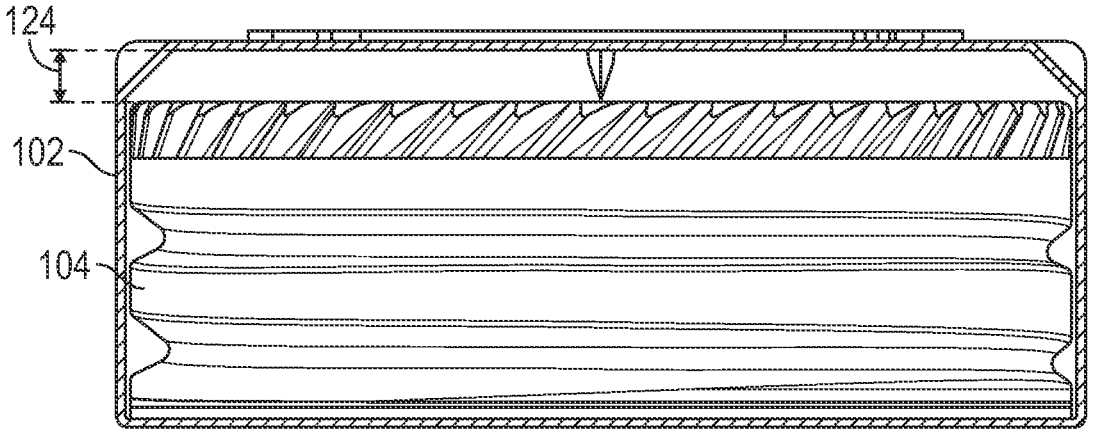

When the axial force is removed, knurls 120 exert enough pressure against the angled side walls of notches 112 to cause outer cap 102 to move away, i.e., in a disengaging direction, from inner cap 104 as shown in FIG. 4C. This restores gap 124 and thus, the child resistant mode of operation.

Figure 5A:
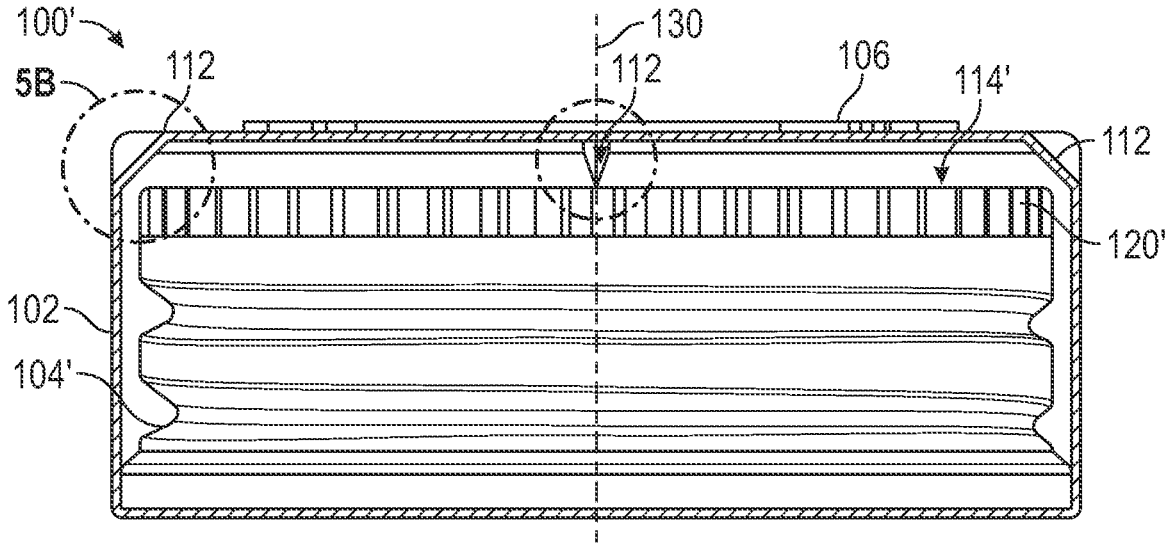
FIG. 5A is a side cutaway view of a child resistant closure in another embodiment where the knurls are aligned parallel to the axis of the closure.
Figure 5B:
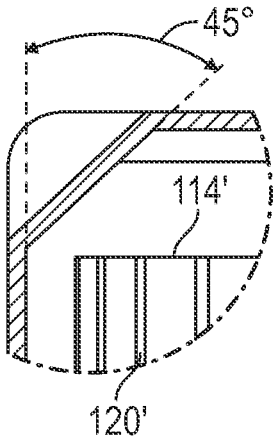
FIG. 5B is a detailed view of the outer cap of the child resistant closure of FIG. 5A.
Figure 5C:
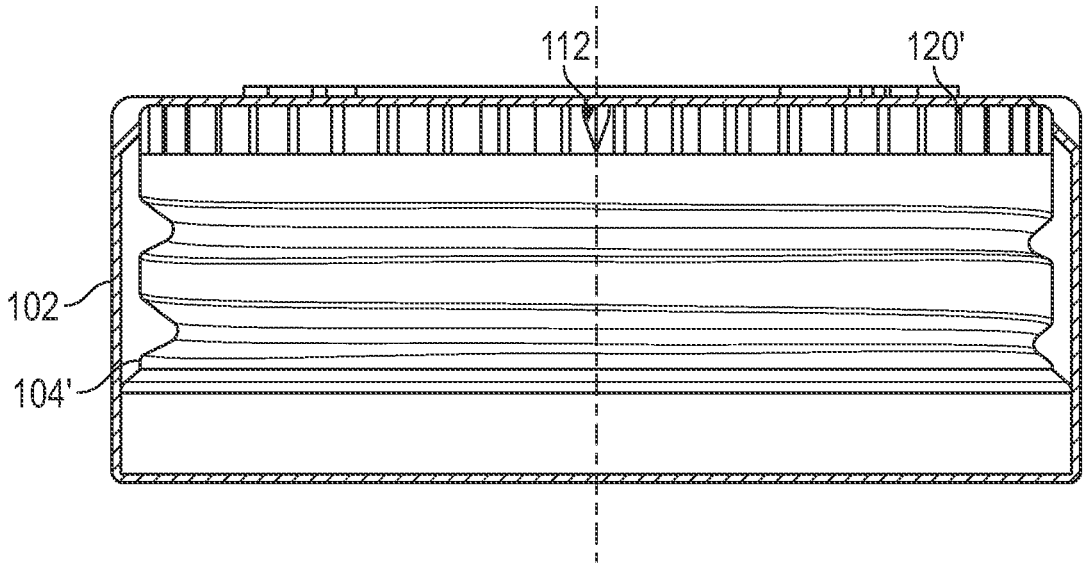
FIG. 5C is a side cutaway view of the closure of FIG. 5A.

FIGS. 5A-5C show another embodiment of a closure 100' where knurls in the inner cap are vertical, or parallel to axis 130, instead of angled as describe above. FIG. 5A is a side cutaway view of a child resistant closure 100' in a child resistant mode. FIG. 5B is a detailed view of the outer cap of closure 100'. FIG. 5C is a side cutaway view of closure 100' in a engaged, or opening mode. FIGS. 5A-5C are best viewed together in the following discussion.

Closure 100' includes outer cap 102 which is an example of outer cap 102 in FIGS. 1A-1C with regard to the dimensions and positioning of notches 112. In embodiments, notches 112 may also have different dimensions and angles than those described above. There may be any number of notches 112 as needed to provide a secure engagement between an outer cap and an inner cap.

Knurls 120' of FIGS. 5A-5C are similar to knurls 120 of FIGS. 3A-3C, however, instead of being angled, knurls 120' are vertically aligned with axis 130. Spacing between adjacent knurls 120' is dimensioned to receive notches 112 therein.

Closure 100' may be operated similarly to closure 100 as described in connection with FIGS. 4A-4C. FIGS. 5A and 5B shows closure 100' in a child resistant mode, where there is a gap between notches and knurls 120'. FIG. 5C shows closure 100' after an axial force is applied to outer cap 102 which causes notches 112 to engage with knurls 120'. In this configuration, torque applied to outer cap 102 will cause inner cap 104' to turn so that closure 100' may be removed from the container. When axial force is removed, i.e., when a user releases the closure, notches 112 will automatically disengage from between the knurls 120'.

It is to be understood that the convertible closure device provided in accordance with the present invention can be formed of any suitable material such as metal, or a combination of materials and the like and that embodiments herein are not intended to be limited by the material from which the devices are formed.

Changes may be made in the above methods and systems without departing from the scope hereof. It should thus be noted that the matter contained in the above description or shown in the accompanying drawings should be interpreted as illustrative and not in a limiting sense. Herein, and unless otherwise indicated: (a) the adjective "exemplary" means serving as an example, instance, or illustration, and (b) the phrase "in embodiments" is equivalent to the phrase "in certain embodiments," and does not refer to all embodiments. The following claims are intended to cover all generic and specific features described herein, as well as all statements of the scope of the present method and system, which, as a matter of language, might be said to fall therebetween.

What is claimed is:

1. A child resistant closure for use with a container having a threaded neck and an axis extending therethrough about which said closure is rotatable, said closure comprising:

an inner cap comprised of metal and having:

an inner top wall;

an inner side wall extending from the inner top wall and having an inner threaded portion for engagement with the threaded portion of the container; and a plurality of knurls on a shoulder formed where the inner side wall meets the inner top wall, the knurls forming an angle of approximately 30 degrees to 60 degrees with respect to a vertical plane including the axis; and an outer cap comprised of metal having;

an outer top wall;

an outer side wall extending from the outer top wall at an outer shoulder and approximately perpendicular to the outer top wall; and a plurality of notches in a shoulder formed on the inside of the outer cap where the outer side wall meets the outer top wall for interengaging with the plurality of knurls so that said inner cap rotates upon rotation of said outer cap in both opening and closing directions, the plurality of notches including:

outer side wall edges that extend downward from the outer shoulder to a first point and form an angle of approximately 30 degrees to 60 degrees with each other;

outer top wall edges that extend inward from the outer shoulder to a second point and form an angle of approximately 30 degrees to 60 degrees with each other; and an abutment surface extending from the first point to the second point at an angle of about 40° to about 50° with the outer side wall.

2. The child resistant closure of claim 1, wherein the plurality of knurls extend around an entire circumference of the inner cap.

3. The child resistant closure of claim 1, wherein every knurl of the plurality of knurls forms the same angle.

4. The child resistant closure of claim 1, wherein the abutment surface of each of the plurality of notches forms an angle of 45° with the outer side wall.

5. The child resistant closure of claim 1, wherein the inner cap has a height along the axis that is less than the height along the axis of the outer cap.

6. A container having a neck for threadably engaging with the child resistant closure of claim 1.

7. The container of claim 6, wherein the container is plastic.

* * * * *